US008152622B2

(12) United States Patent
Kim

(10) Patent No.: US 8,152,622 B2
(45) Date of Patent: Apr. 10, 2012

(54) GAMING SYSTEM AND METHOD HAVING CONTROLLABLY ROTATABLE DIRECTING DEVICES FOR USE WITH A MARKER

(75) Inventor: Hyong Joo Kim, Meadowbank (AU)

(73) Assignee: Aristocrat Technologies Australia Pty Limited (AU)

( * ) Notice: Subject to any disclaimer, the term of this patent is extended or adjusted under 35 U.S.C. 154(b) by 492 days.

(21) Appl. No.: 12/402,254

(22) Filed: Mar. 11, 2009

(65) Prior Publication Data

US 2009/0233701 A1 Sep. 17, 2009

(30) Foreign Application Priority Data

Mar. 11, 2008 (AU) ..... 2008901136

(51) Int. Cl.
*A63B 71/00* (2006.01)

(52) U.S. Cl. ..... 463/17; 273/142 R

(58) Field of Classification Search ..... 273/142 HA, 273/142 R; 463/17, 25
See application file for complete search history.

(56) References Cited

U.S. PATENT DOCUMENTS

| | | | | |
|---|---|---|---|---|
| 3,771,792 | A | 11/1973 | Crumlish | |
| 4,898,392 | A | 2/1990 | Goletz | |
| 5,135,218 | A | 8/1992 | McGovern | |
| 5,542,870 | A | 8/1996 | Westersund | |
| 5,755,440 | A * | 5/1998 | Sher | 273/142 E |
| 6,386,994 | B1 | 5/2002 | H'Doubler et al. | |
| 2002/0090988 | A1 | 7/2002 | Frost et al. | |
| 2002/0109291 | A1 | 8/2002 | Lawrence | |
| 2004/0059445 | A1 * | 3/2004 | Moore et al. | 700/91 |
| 2006/0199656 | A1 | 9/2006 | McGovern | |
| 2006/0267274 | A1 * | 11/2006 | Cammegh | 273/138.1 |
| 2007/0155481 | A1 | 7/2007 | Vancura | |

FOREIGN PATENT DOCUMENTS

| | | |
|---|---|---|
| CA | 1094119 | 1/1981 |
| GB | 189801001 | 3/1899 |
| GB | 190610779 | 8/1906 |
| GB | 190606922 | 9/1906 |
| GB | 265411 | 2/1927 |
| GB | 262725 | 9/1927 |
| GB | 286534 | 3/1928 |
| GB | 335633 | 10/1930 |
| GB | 395561 | 7/1933 |
| GB | 443174 | 2/1936 |
| GB | 456153 | 11/1936 |
| GB | 701847 | 1/1954 |
| GB | 1083402 | 9/1967 |
| GB | 2219915 | 12/1989 |
| GB | 2424191 | 9/2006 |
| JP | 6190114 | 7/1994 |

(Continued)

*Primary Examiner* — Thomas L Dickey
(74) *Attorney, Agent, or Firm* — McAndrews, Held & Malloy, Ltd.

(57) ABSTRACT

A gaming system is disclosed which comprises a first game region comprising a plurality of game portions, and a second game region contiguous with each of the game portions. The second game region comprises a plurality of directing devices, with each directing device being selectively individually controllable so that a marker disposed in the second game region is directable into any game portion of the first region by one or more of the directing devices. A winning outcome is indicated based on the game portion into which a marker is directed during use. A corresponding method is also disclosed.

42 Claims, 8 Drawing Sheets

FOREIGN PATENT DOCUMENTS

| | | |
|---|---|---|
| JP | 10179864 | 7/1998 |
| JP | 2000037511 | 2/2000 |
| JP | 2000037512 | 2/2000 |
| JP | 2000084167 | 3/2000 |
| JP | 2000288201 | 10/2000 |
| JP | 2000300771 | 10/2000 |
| JP | 2002224362 | 8/2002 |
| JP | 2002224363 | 8/2002 |
| WO | W02007077449 | 7/2007 |

* cited by examiner

GAMING SYSTEM AND METHOD HAVING CONTROLLABLY ROTATABLE DIRECTING DEVICES FOR USE WITH A MARKER

RELATED APPLICATIONS

This application claims priority to Australian Provisional Patent Application No. 2008901136, having a filing date of Mar. 11, 2008, entitled "A Gaming System And A Method Of Gaming," which is hereby incorporated by reference herein in its entirety.

BACKGROUND OF THE INVENTION

The present invention relates to a gaming system and to a method of gaming.

It is known to provide a gaming system which comprises at least one wheel provided with a plurality of identifiers equidistantly disposed around the wheel. The wheel is rotatable and game outcomes are determined using a pointer disposed adjacent the periphery of the wheel.

However, while such gaming systems provide users with enjoyment, a need exists for alternative gaming systems in order to maintain or increase player enjoyment.

SUMMARY OF THE INVENTION

In accordance with a first aspect of the present invention, there is provided a gaming system comprising:

a first game region comprising a plurality of game portions; and a second game region contiguous with each of the game portions;

the second game region comprising a plurality of directing devices, each directing device being selectively individually controllable so that a marker disposed in the second game region is directable into any game portion of the first region by one or more of the directing devices;

wherein a winning outcome is indicated based on the game portion into which a marker is directed during use.

In one embodiment, the gaming system comprises a selector arranged to select a game portion, for example randomly using a random number generator, and the marker is subsequently directed to the selected game portion by the directing devices.

In an alternative arrangement, the game portion into which a marker is directed is randomly selected by randomly controlling the directing devices.

In one embodiment, each game portion has an associated identifier which may comprise a symbol, number, icon or picture, or may be in the form of a particular colour, the identifier being usable to identify game portions for bet placement purposes.

In addition or alternatively, each game portion has an associated identifier in the form of a multiplier usable to provide an indication to a player as to a prize awardable if the marker is directed into the game portion.

In one embodiment, the gaming system comprises physical first and second game regions.

In an alternative embodiment, the gaming system is implemented electronically such that the first and second game regions are represented graphically on a video display.

The gaming system may further comprise a display controller arranged to cause a game portion which receives a marker to be emphasised relative to game portions which do not receive a marker.

In an embodiment wherein the gaming system comprises physical game portions, the gaming system may comprise a plurality of light devices, each light device being associated with one of the game portions, and the light devices being controllable by the display controller so as to illuminate the game portion which receives a marker. The light devices may be LEDs.

In one embodiment, the display controller may be arranged so as to illuminate the game portion which receives a marker with an intensity greater than game portions which do not receive a marker.

In one embodiment, the display controller may be arranged so as to illuminate the game portion which receives a marker with a different colour than game portions which do not receive a marker.

In one embodiment, the display controller may be arranged so as to cause the game portion which receives a marker to flash.

In one embodiment, the first game region is of generally circular configuration, the game portions are segments of the circle, and the second game region is of generally annular configuration surrounding the first game portion.

In one embodiment, the gaming system comprises an outcome evaluator arranged to determine whether a winning outcome exists on the basis of the game portion which receives a marker.

In one embodiment, the marker is a ball.

In one embodiment, each directing device is of generally cross-like configuration and is rotatably mounted in the second game region, the direction and speed of rotation of the directing devices being selectively individually controllable. In one arrangement, three directing devices are disposed adjacent each game portion.

In one embodiment, one or more of the selector and the outcome evaluator is constituted, at least in part, by a processor executing program code stored in a memory.

In one embodiment, the gaming system comprises a game play mechanism operable to place a wager and the outcome evaluator evaluates the outcome based on the wager and based on the game portion which receives a marker.

The gaming system may comprise at least one player operable gaming device in the form of a gaming machine.

In addition or alternatively, the gaming device may comprise a gaming terminal and the gaming system may further comprise a gaming server arranged to cooperate with the at least one gaming terminal so as to implement a game.

In accordance with a second aspect of the present invention, there is provided a method of gaming, the method comprising:

providing a first game region comprising a plurality of game portions;

providing a second game region contiguous with each of the game portions;

disposing a marker into the second game region;

directing a marker into a game portion by selectively individually controlling a plurality of directing devices; and indicating a winning outcome based on the game portion into which a marker is directed during use.

In accordance with a third aspect of the present invention, there is provided a computer program arranged when loaded into a computer to instruct the computer to operate in accordance with a gaming system comprising:

a first game region comprising a plurality of game portions; and a second game region contiguous with each of the game portions;

the second game region comprising a plurality of directing devices, each directing device being selectively individually controllable so that a marker disposed in the second game region is directable into any game portion of the first region by one or more of the directing devices;

wherein a winning outcome is indicated based on the game portion into which a marker is directed during use.

In accordance with a fourth aspect of the present invention, there is provided a computer readable medium having computer readable program code embodied therein, the computer readable program code being arranged when loaded into a computer to cause the computer to operate in accordance with a gaming system comprising:

a first game region comprising a plurality of game portions; and a second game region contiguous with each of the game portions;

the second game region comprising a plurality of directing devices, each directing device being selectively individually controllable so that a marker disposed in the second game region is directable into any game portion of the first region by one or more of the directing devices;

wherein a winning outcome is indicated based on the game portion into which a marker is directed during use.

In accordance with a fifth aspect of the present invention, there is provided a data signal having computer readable program code embodied therein for causing a computer to operate in accordance with a gaming system comprising:

a first game region comprising a plurality of game portions; and a second game region contiguous with each of the game portions;

the second game region comprising a plurality of directing devices, each directing device being selectively individually controllable so that a marker disposed in the second game region is directable into any game portion of the first region by one or more of the directing devices;

wherein a winning outcome is indicated based on the game portion into which a marker is directed during use.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
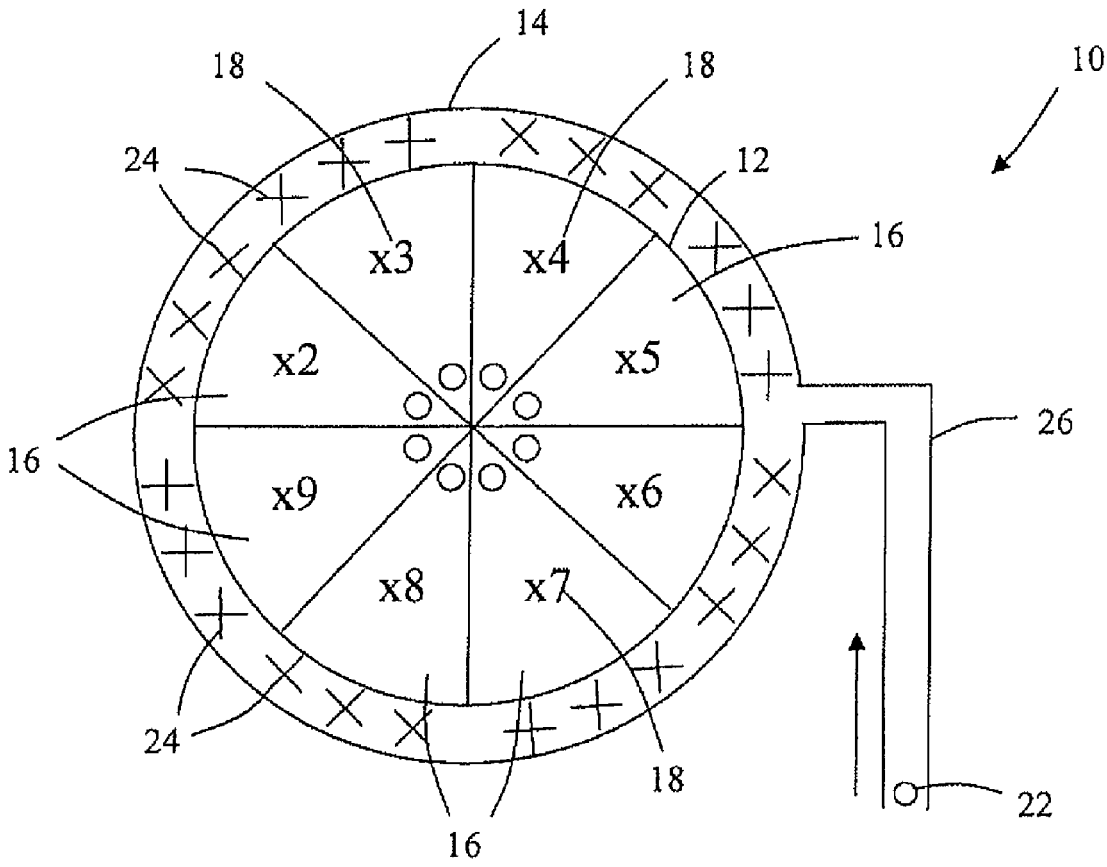
FIG. 1 is a diagrammatic representation of a gaming system in accordance with an aspect of the present invention.

Referring to the drawings, In FIG. 1 there is shown a gaming system 10 arranged to implement a probabilistic game.

The gaming system 10 comprises a first game region, in this example an inner game region 12 of generally circular configuration, and a second game region, in this example an outer game region 14 of generally annular configuration surrounding the inner game region 12.

The inner game region 12 comprises a plurality of game portions 16, each of which has an associated identifier 18 usable in this example to provide an indication to a player as to the prize awardable to the player in the event that a winning outcome occurs.

Each identifier 18 in this example is in the form of a multiplier and operation of the system 10 is such that during use a bet is placed by a player in respect of one or more of the game portions 16, the gaming system randomly selects at least one of the game portions 16, and if the game portion 16 in respect of which a bet has been placed by a player is selected by the system 10, a prize based on the amount bet and the multiplier associated with the selected game portion 16 is awarded to the player.

However, it will be understood that other arrangements are envisaged. For example, the game portions 16 may be provided with identifiers 18 to distinguish game portions 16 from each other for bet application purposes.

As an alternative to providing each game portion 16 with an identifier in the form of a multiplier, each game portion 16 may include an identifier in the form of a symbol such as a number, icon, picture and so on, or each identifier may be in the form of a particular colour.

In one embodiment, players may place bets directly onto the inner game portion 12 above the game portion(s) 16 in respect of which one or more bets are desired to be placed.

In this example, the game portions 16 are segments of the inner game region 12, and each game portion has an associated ball outlet 20.

Operation of the gaming system 10 is such that at least one game portion 16 is selected randomly and a game outcome is communicated to a player by directing a ball 22 to the selected game portion and thereby through the ball outlet 20 of the selected game portion 16.

The ball 22 is directed to the appropriate selected game portion 16 using directing devices 24 disposed around the outer game region 14. The outer game region 14 is in communication with a ball inlet tube 26 which during a game directs the ball 22 towards the outer game region 14. Each directing device 24 is selectively individually controllable so as to direct a ball in a clockwise direction around the outer game portion 14, in an anticlockwise direction around the outer game portion 14, or in a generally radial direction towards a game portion 16. In this embodiment, each directing device 24 is of generally cross-like configuration, with the cross being rotatably mounted in the outer game portion and the direction of rotation being controllable such that the direction of movement of the ball 22 is controllable when the ball impinges on the directing device 24.

In this embodiment, in order for a player to clearly see which game portion has been selected, the selected game portion 16 is illuminated, for example by disposing an LED under each game portion 16 and illuminating the LED associated with the selected game portion 16.

In the present embodiment, one game portion 16 is selected during each game. However, it will be understood that as an alternative multiple game portions 16 may be selected and communicated to a player by directing multiple balls 22 to multiple selected game portions 16.

Figure 2:
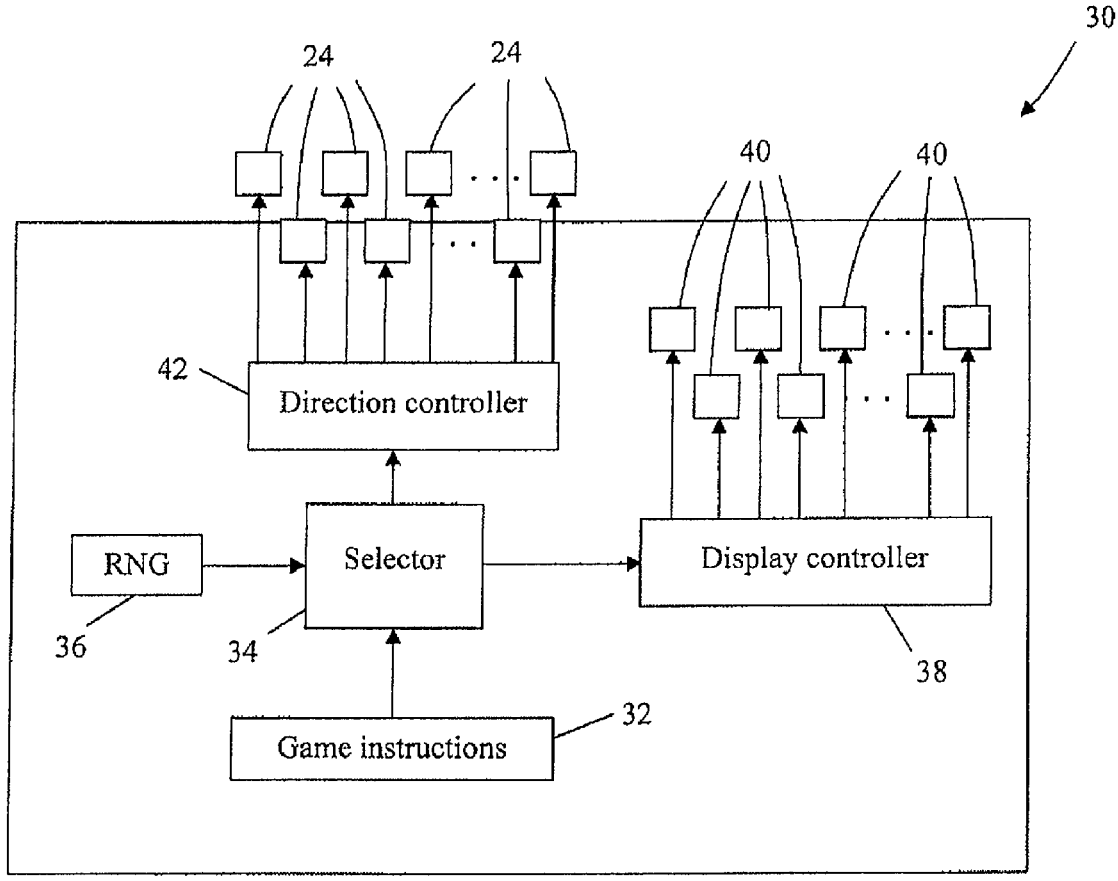
FIG. 2 is a schematic diagram of a game controller of the gaming system shown in FIG. 1.

A game controller 30 for controlling operation of the gaming system 10 is shown diagrammatically in FIG. 2.

The game controller 30 comprises a memory 32 arranged to store game instructions and any other data required to operate the gaming system to implement a game, a selector 34 arranged to select at least one game portion 16 using a random number generator 36, a display controller 38 arranged to communicate with light devices 40 associated with the game portions 16 so as to cause the or each selected game portion 16 to illuminate relative to game portions and game panels which have not been selected. In this example, the light devices comprise LEDs, although it will be appreciated that other light devices may be used.

It will be appreciated that the random number generator 36 may be of a type which is arranged to generate pseudo random numbers based on a seed number, and that in this specification the term "random" will be understood accordingly to mean truly random or pseudo random.

The game controller 30 also comprises a direction controller 42 which receives a communication from the selector 34 indicative of the selected game portion 16 and effects appropriate control of the directing devices 24 so as to direct the ball 22 to the selected game portion 16.

Figure 3:
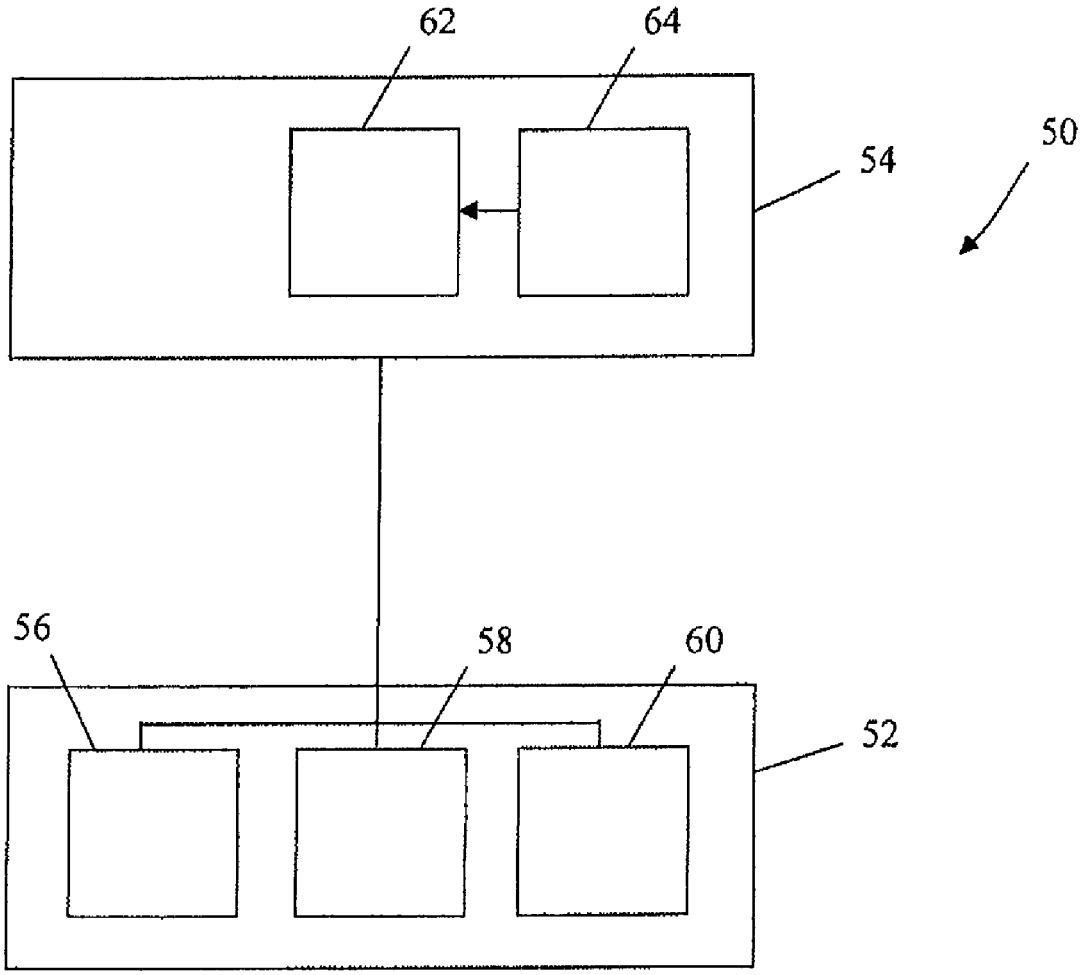
FIG. 3 is a schematic block diagram of a gaming system in accordance with an alternative embodiment of the present invention.

An alternative gaming system 50 implemented electronically is shown schematically in FIG. 3.

Operation is similar to the embodiment shown in FIGS. 1 and 2 with the difference being that a video representation of the inner and outer game regions 12, 14 is shown on an electronic gaming device. For the purpose of describing this embodiment, like and similar features to features described in relation to FIGS. 1 and 2 are indicated with like reference numerals.

Operation of the present embodiment is such that at least one game portion 16 is randomly selected and the or each selected game portion 16 is communicated to a player by displaying a representation of a ball 22 moving from a ball inlet 26 to the outer game region 14 and being directed to the selected game portion 16 by the directing devices 24.

The gaming system 50 comprises a player interface 52 and a game controller 54. The player interface 52 is arranged to enable interaction between a player and the gaming system and for this purpose includes input/output components required for the player to enter instructions and play the game.

Components of the player interface 52 may vary but will typically include a credit mechanism 56 to enable a player to input credits and receive payouts, one or more displays 58 which may comprise a touch screen, and a game play mechanism 60 arranged to enable a player to input game play instructions.

The game controller 54 is in data communication with the player interface 52 and typically includes a processor 62 arranged to process game play instructions and output game player outcomes to the display 58. Typically, the game play instructions are stored as program code in a memory 64 that can also be hardwired. It will be understood that in this specification the term "processor" is used to refer generically to any device that can process game play instructions and may include a microprocessor, microcontroller, programmable logic device or other computational device such as a personal computer or a server.

Figure 4:
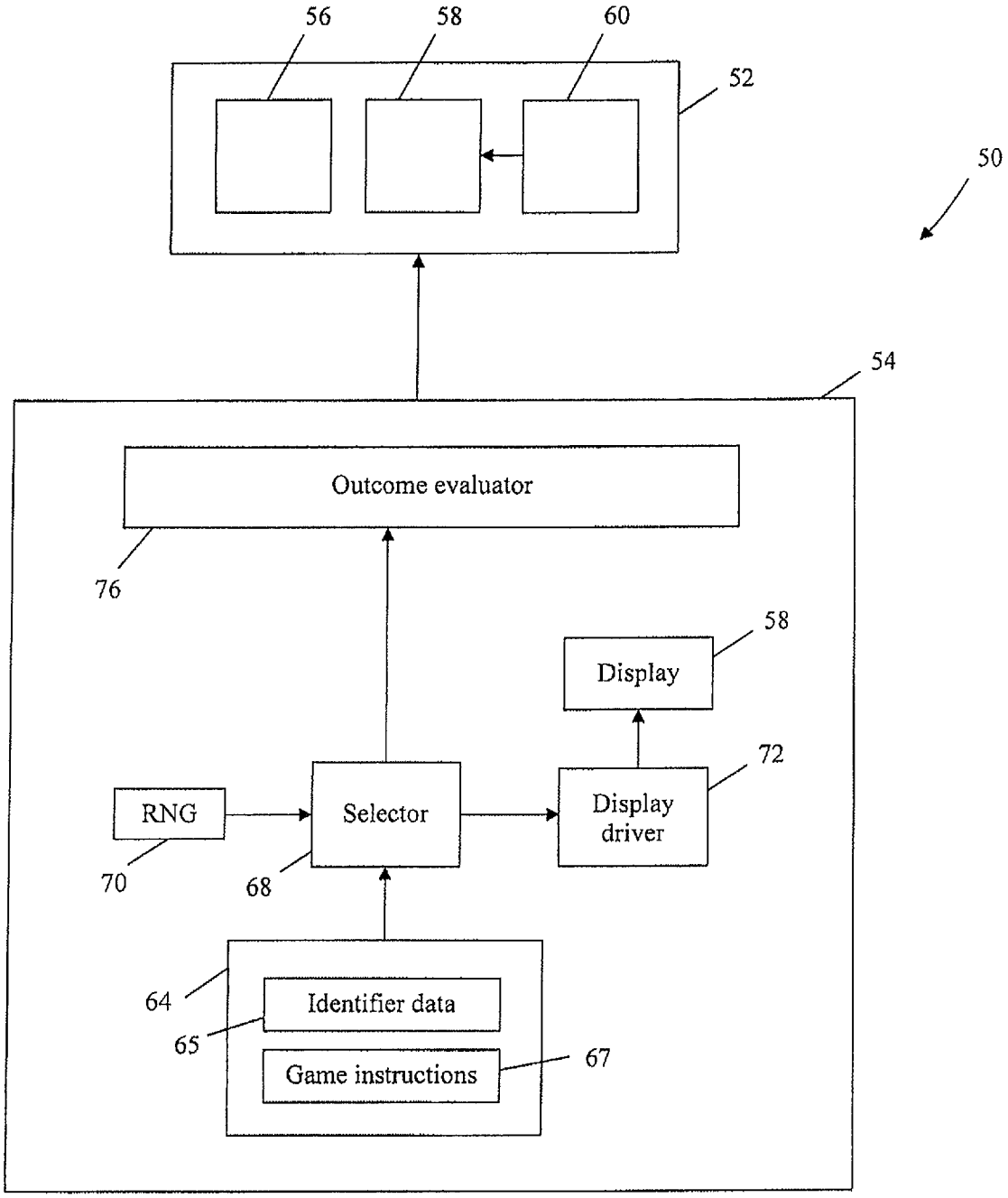
FIG. 4 is a schematic block diagram illustrating operative components of the gaming system shown in FIG. 3.

A functional diagram illustrating operative components of the game controller 54 is shown in FIG. 4.

The memory 64 is arranged to store identifier data 65 indicative of identifiers associated with the game portions 16 such as symbols associated with the game portions, multipliers associated with the game portions 16, and/or colours associated with the game portions 16, and game instruction data 67 indicative of game instructions usable by the gaming machine 50 to control operation of the game.

The game controller 54 includes a selector 68 which is arranged to select at least one game portion 16. In this example, the selection carried out by the selector 68 is made using a random number generator 70.

It will be appreciated that the random number generator 70 may be of a type which is arranged to generate pseudo random numbers based on a seed number, and that in this specification the term "random" will be understood accordingly to mean truly random or pseudo random.

The game controller 54 also includes a display controller 72 arranged to modify the display so as to provide the appearance on a graphical display of the gaming machine 50 of a ball 22 which is directed by the directing devices 24 to a game portion 16. In the present example, a selected game portion 16 is also emphasised by displaying the selected game portion 16 with greater intensity than game portions which have not been selected. However, other variations are possible, such as displaying the selected game portions 16 in a different colour, causing the selected game portions to flash, and so on.

The game controller 54 also comprises an outcome evaluator 76 which in accordance with the game instructions 67 determines game outcomes based on the or each selected game portion 16.

In the embodiments described below, the selector 68, the display controller 72 and the outcome evaluator 76 are at least partly implemented using the processor 62 and associated software, although it will be understood that other implementations are envisaged.

The gaming system 10 can take a number of different forms.

In a first form, a gaming system in the form of a stand alone gaming device, hereinafter referred to as a gaming machine, is provided wherein all or most components required for implementing the game are present in the gaming machine.

In a second form, a distributed architecture is provided wherein some of the components required for implementing the game are present in a player operable gaming device and some of the components required for implementing the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 5:
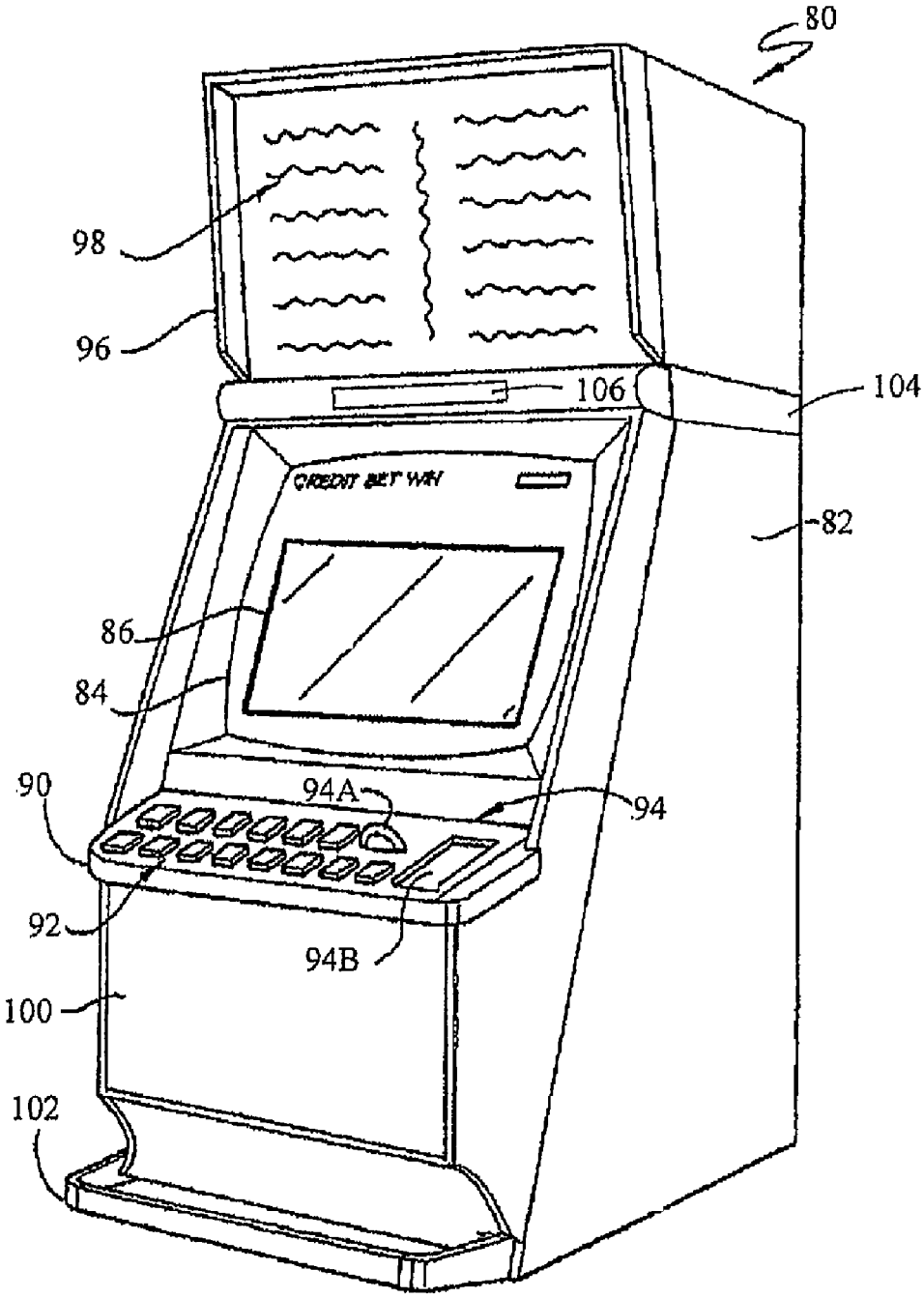
FIG. 5 is a diagrammatic representation of a gaming system implemented in the form of a gaming machine.

A gaming system in the form of a stand alone gaming machine 80 is illustrated in FIG. 5. The gaming machine 80 includes a console 82 having a display 84 on which is displayed representations of a game 86 that can be played by a player. A mid-trim 90 of the gaming machine 80 houses a bank of buttons 92 for enabling a player to interact with the gaming machine, in particular during game play. The mid-trim 90 also houses a credit input mechanism 94 which in this example includes a coin input chute 94A and a bill collector 94B. Other credit input mechanisms may also be employed, for example, a card reader for reading a smart card, debit card or credit card.

A top box 96 may carry artwork 98, including for example pay tables and details of bonus awards and other information or images relating to the game. Further artwork and/or information may be provided on a front panel 100 of the console 82. A coin tray 102 is mounted beneath the front panel 100 for dispensing cash payouts from the gaming machine 80.

The display 84 is in the form of a video display unit, particularly a cathode ray tube screen device. Alternatively, the display 84 may be a liquid crystal display, plasma screen, or any other suitable video display unit. The top box 96 may also include a display, for example a video display unit, which may be of the same type as the display 84, or of a different type. The display 84 may comprise a touch screen usable by a player to interact with the gaming machine, in particular during game play.

The display 84 in this example is arranged to display a representation of the inner and outer game regions 12, 14, for example in a disk-like configuration wherein the inner region 12 is of generally circular configuration and the outer region 14 is of generally annular configuration, as shown in FIG. 1.

A player marketing module (PMM) 104 having a display 106 is connected to the gaming machine 10. The main purpose of the PMM 104 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 6:
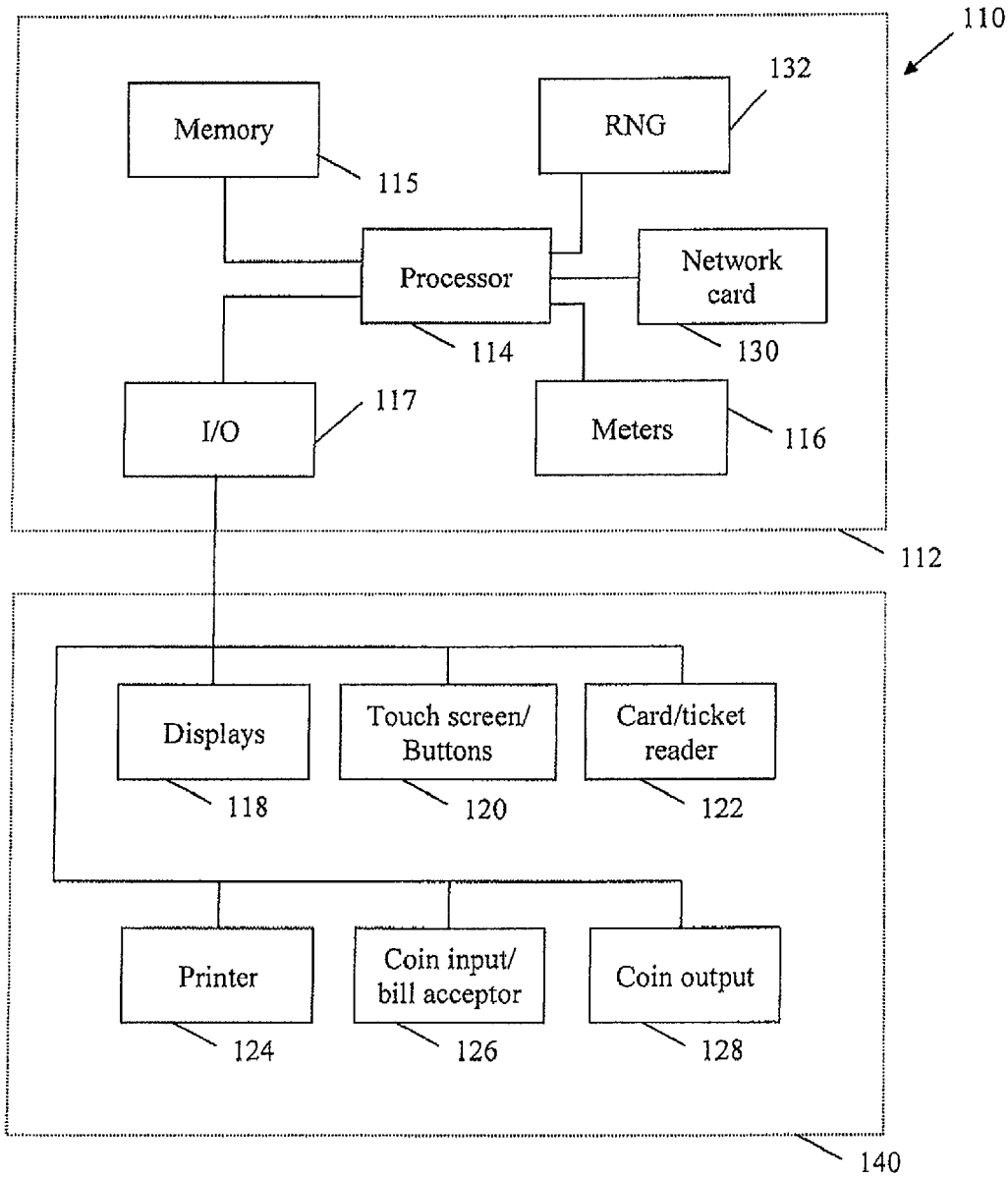
FIG. 6 is a schematic block diagram of operative components of the gaming machine shown in FIG. 5.

FIG. 6 shows a block diagram of operative components of a gaming machine 110 which may be the same as or different to the gaming machine shown in FIG. 5.

The gaming machine 110 includes a game controller 112 having a processor 114. Instructions and data to control operation of the processor 114 in accordance with the present invention are stored in a memory 115 which is in data communication with the processor 114.

Typically, the gaming machine 110 will include both volatile and non-volatile memory and more than one of each type of memory, with such memories being collectively represented by the memory 115.

Figure 7:
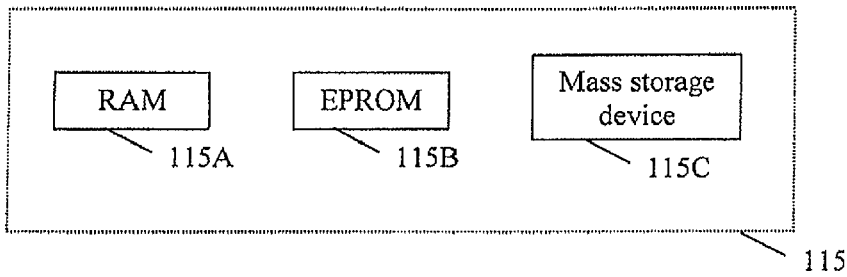
FIG. 7 is a schematic block diagram of components of a memory of the gaming machine shown in FIG. 5.

FIG. 7 shows a block diagram of the main components of an exemplary memory 115. The memory 115 includes RAM 115A, EPROM 115B and a mass storage device 115C. The RAM 115A typically temporarily holds program files for execution by the processor 114 and related data. The EPROM 115B may be a boot ROM device and/or may contain some system or game related code. The mass storage device 103C is typically used to store game programs, the integrity of which may be verified and/or authenticated by the processor 114 using protected code from the EPROM 115B or elsewhere.

The gaming machine has hardware meters 116 for purposes including ensuring regulatory compliance and monitoring player credit, an input/output (I/O) interface 117 for communicating with a player interface 140 of the gaming machine 110, the player interface 140 having several peripheral devices. The input/output interface 117 and/or the peripheral devices may be intelligent devices with their own memory for storing associated instructions and data for use with the input/output interface or the peripheral devices. A random number generator module 132 generates random numbers for use by the processor 114.

In the example shown in FIG. 6, the peripheral devices that communicate with the game controller 112 comprise one or more displays 118, a touch screen and/or bank of buttons 120, a card and/or ticket reader 122, a printer 124, a bill acceptor and/or coin input mechanism 126 and a coin output mechanism 128. Additional hardware may be included as part of the gaming machine 110, or hardware may be omitted as required for the specific implementation.

In addition, the gaming machine 110 may include a communications interface, for example a network card 130. The network card may, for example, send status information, accounting information or other information to a central controller, server or database and receive data or commands from the central controller, server or database.

It is also possible for the operative components of the gaming machine 110 to be distributed, for example input/output devices 118, 120, 122, 124, 126, 128 may be provided remotely from the game controller 112.

Figure 8:
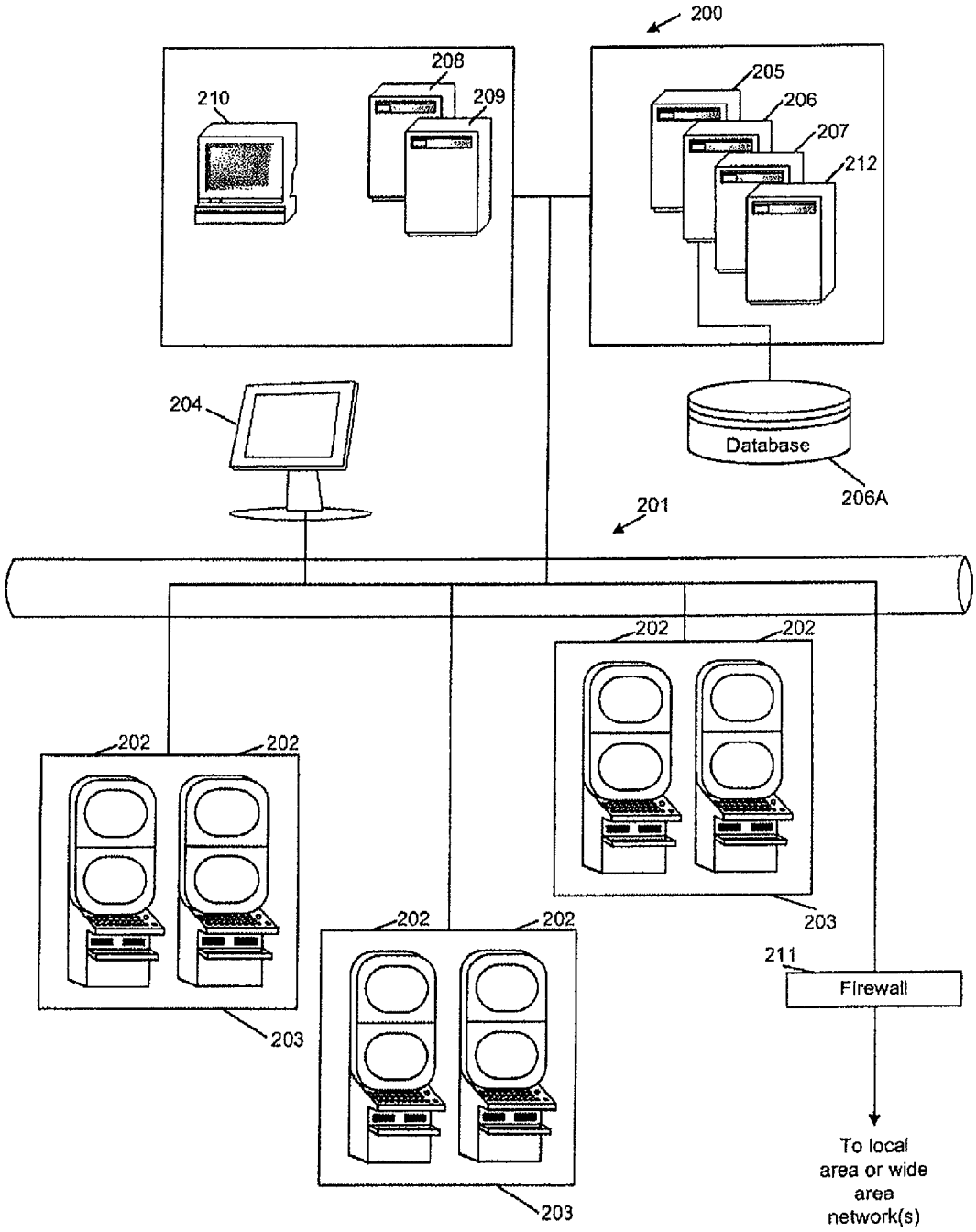
FIG. 8 is a schematic diagram of a gaming system in accordance with an alternative embodiment of the present invention.

FIG. 8 shows a gaming system 200 in accordance with an alternative embodiment. The gaming system 200 includes a network 201, which for example may be an Ethernet network, a LAN or a WAN. In this example, three banks 203 of two gaming terminals 202 are connected to the network 201. The gaming terminals 202 provide a player operable interface. While banks 203 of two gaming terminals are illustrated in FIG. 8, banks of one, three or more gaming terminals are also envisaged.

One or more displays 204 may also be connected to the network 201. The displays 204 may, for example, be associated with one or more banks 203 of gaming terminals. The displays 204 may be used to display representations associated with game play on the gaming terminals 202, and/or used to display other representations, for example promotional or informational material.

In a thick client embodiment, a game server 205 implements part of the game played by a player using a gaming terminal 202 and the gaming terminal 202 implements part of the game. With this embodiment, as both the game server 205 and the gaming terminal 202 implement part of the game, they collectively provide a game controller. A database management server 206 may manage storage of game programs and associated data for downloading or access by the gaming terminals 202 in a database 206A. Typically, if the gaming system enables players to participate in a Jackpot game, a Jackpot server 207 will be provided to monitor and carry out the Jackpot game.

In a variation of the above thick client embodiment, the gaming terminal 202 may implement the game, with the game server 205 functioning merely to serve data indicative of a game to the gaming terminal 202 for implementation.

With this implementation, a data signal containing a computer program usable by the gaming terminal to implement the gaming system may be transferred from the game server to the gaming terminal, for example in response to a request by the gaming terminal.

In a thin client embodiment, the game server 205 implements most or all of the game played by a player using a gaming terminal 202 and the gaming terminal 202 essentially provides only the player interface. With this embodiment, the game server 205 provides the game controller. The gaming terminal will receive player instructions, and pass the instructions to the game server which will process them and return game play outcomes to the gaming terminal for display. In a thin client embodiment, the gaming terminals could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine or over a network, implements a probabilistic game wherein at least during part of the game the gaming system selects one or more game portions 16, and communicates the or each selected game portion 16 to a player by directing a ball 22 to the selected game portion 16. In order to increase player anticipation, the ball 22 is directed by multiple directing devices 24 each of which is capable of directing the ball in an anticlockwise direction, a clockwise direction, or a generally radial direction so that the ball 22 may be directed in multiple directions and to locations adjacent multiple prior to being directed towards the selected game portion 16.

Figure 9:
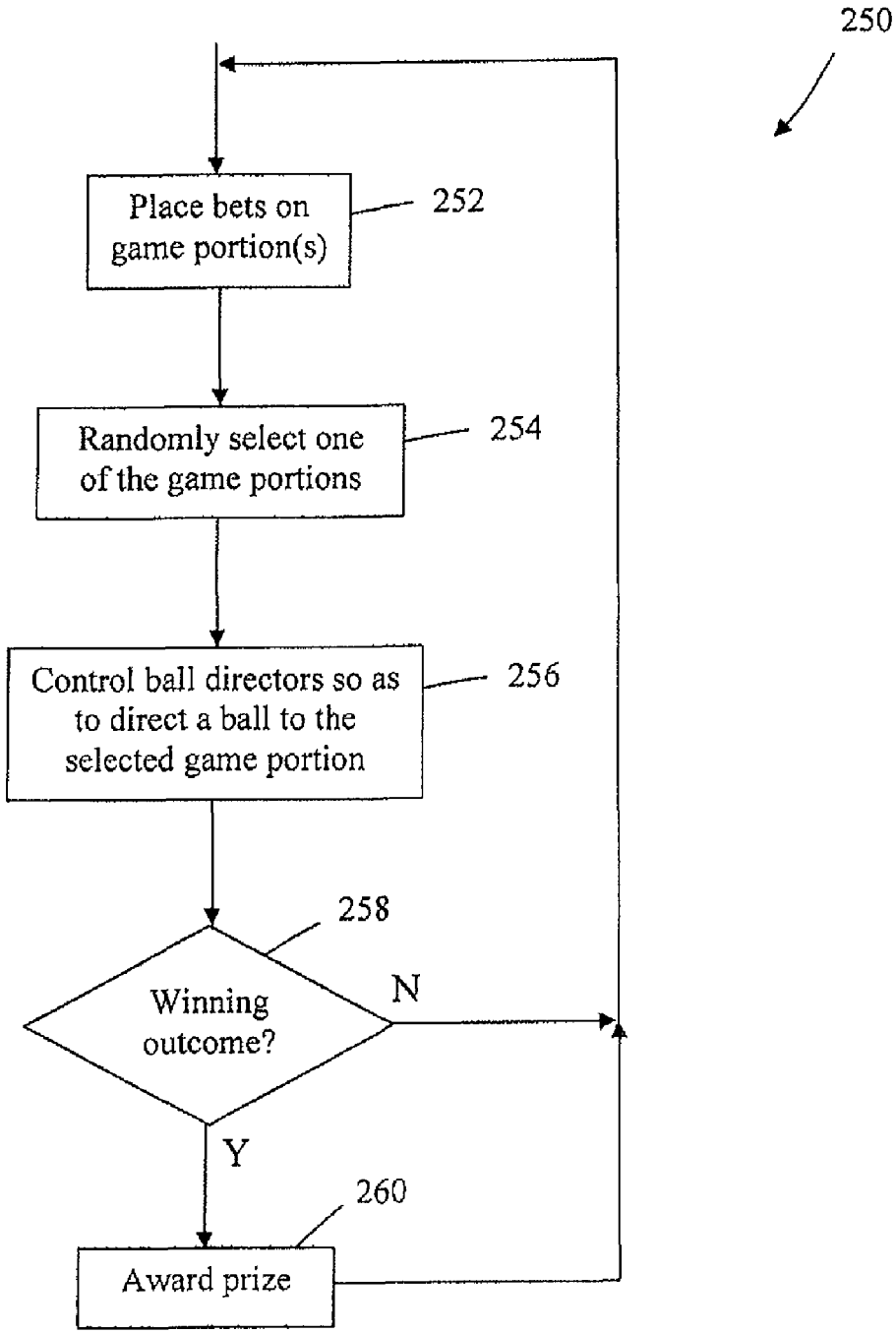
FIG. 9 is a flow diagram illustrating operation of a gaming system in accordance with an embodiment of the present invention during use.

Examples of specific implementations of the gaming system will now be described in relation to flow diagram 250 shown in FIG. 9 which illustrates steps 252 to 260 of a method of gaming implemented by the gaming system according to the embodiment shown in FIG. 1.

However, it will be understood that implementation may also be carried out using other gaming system architectures such as a stand alone electronic gaming machine 50 shown in FIG. 5, or as a network architecture of the type shown in FIG. 8.

In order to take part in the game implemented by the gaming system 10, a player first places a bet, in this example in respect of one or more game portions 16. The bets may be placed directly on the relevant game portions 16 so that all players and operators of the gaming system can clearly see the bets placed. After receipt of all bets, a game operator starts the gaming system 10 which causes the selector 34 to randomly select one of the game portions and a ball 22 to be launched through the ball inlet tube 26 and into the outer game region 14. The ball 22 is directed in one or multiple directions by the directing means 24 and ultimately towards the selected game portion 16. The ball 22 then passes through the ball outlet 20 of the selected game portion 16 and is directed back to the ball inlet tube 26.

In order to provide a clear indication to players as to which game portion has been selected, the selected game portion 16 may be highlighted, for example by illuminating an LED associated with the selected game portion 16.

If any player has placed a bet in respect of one of a selected game portion 16, operators of the gaming system 10 award a prize to the or each player. The prize may be a monetary amount based on the amount bet and in this example calculated by multiplying the bet amount by a win multiplier 18 associated with the selected game portion 16.

The game implemented by the gaming system 10 may be played by one player or by multiple players simultaneously.

In an alternative example, instead of selecting a game portion 16 and subsequently controlling the directing devices 24 according to the selected game portion 16, the gaming system may be arranged to select a game portion by randomly controlling the directing devices 24.

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

Modifications and variations as would be apparent to a skilled addressee are deemed to be within the scope of the present invention.

The invention claimed is:

1. A gaming system comprising:

a first game region comprising a plurality of game portions; and a second game region contiguous with each of the game portions;

the second game region comprising a plurality of directing devices, each directing device being selectively individually controllable so that a marker disposed in the second game region is directable into any game portion of the first region by one or more of the directing devices; and wherein a winning outcome is indicated based on the game portion into which a marker is directed during use; and wherein each directing device is of generally cross-like configuration and is rotatably mounted in the second game region, the direction and speed of rotation of the directing devices being selectively individually controllable.

2. A gaming system as claimed in claim 1, wherein three directing devices are disposed adjacent each game portion.

3. A gaining system as claimed in claim 1, wherein the gaming system comprises a game play mechanism operable to place a wager and the outcome evaluator evaluates the outcome based on the wager and based on the game portion which receives a marker.

4. A gaming system as claimed in claim 1, comprising a selector arranged to select a game portion, wherein the marker is directed to the selected game portion by one or more of the directing devices.

5. A gaining system as claimed in claim 4, wherein the selector is arranged to select a game portion randomly.

6. A gaming system as claimed in claim 4, wherein one or more of the selector and the outcome evaluator is constituted, at least in part, by a processor executing program code stored in a memory.

7. A gaming system as claimed in claim 1, wherein the game portion into which a marker is directed is selected by randomly controlling the directing devices.

8. A gaming system as claimed in claim 1, wherein each game portion has an associated identifier.

9. A gaming system as claimed in claim 8, wherein at least one identifier comprises a symbol, number, icon or picture, or is in the form of a particular colour.

10. A gaming system as claimed in claim 8, wherein the identifier is indicative of a prize awardable if the marker is directed into the game portion.

11. A gaming system as claimed in claim 10, wherein the identifier is a multiplier.

12. A gaming system as claimed in claim 1, wherein the gaming system comprises physical first and second game regions.

13. A gaming system as claimed in claim 1, wherein the gaming system is implemented electronically such that the first and second game regions and the inlet are represented graphically on a video display.

14. A gaming system as claimed in claim 13, wherein the gaming system comprises at least one player operable gaming device.

15. A gaming system as claimed in claim 14, wherein the gaming device is in the form of a gaming machine.

16. A gaining system as claimed in claim 14, wherein the gaming device comprises a gaming terminal and the gaming system further comprises a gaming server arranged to cooperate with the at least one gaming terminal so as to implement a game.

17. A gaming system as claimed in claim 1, comprising a display controller arranged to cause a game portion which receives a marker to be emphasised relative to game portions which do not receive a marker.

18. A gaming system as claimed in claim 17, comprising a plurality of light devices, each light device being associated with one of the game portions, and the light devices being controllable by the display controller so as to illuminate the game portion which receives a marker.

19. A gaming system as claimed in claim 17, wherein the display controller is arranged so as to illuminate the game portion which receives a marker with an intensity greater than game portions which do not receive a marker.

20. A gaming system as claimed in claim 17, wherein the display controller is arranged so as to illuminate the game portion which receives a marker with a different colour than game portions which do not receive a marker.

21. A gaming system as claimed in claim 17, wherein the display controller is arranged so as to cause the game portion which receives a marker to flash.

22. A gaming system as claimed in claim 1, wherein the first game region is of generally circular configuration, the game portions are segments of the circle, and the second game region is of generally annular configuration surrounding the first game portion.

23. A gaming system as claimed in claim 1, comprising an outcome evaluator arranged to determine whether a winning outcome exists on the basis of the game portion which receives a marker.

24. A gaming system as claimed in claim 1, wherein the marker is a ball.

25. A gaming system as claimed in claim 1 and including a computer program.

26. A gaming system as claimed in claim 1 and including a computer readable medium having computer readable program code embodied therein.

27. A gaming system as claimed in claim 1 and including a data signal having computer readable program code embodied therein.

28. A method of gaming, the method comprising:

providing a first game region comprising a plurality of game portions;

providing a second game region contiguous with each of the game portions;

disposing a marker into the second game region;

directing a marker into a game portion by selectively individually controlling a plurality of directing devices; and indicating a winning outcome based on the game portion into which a marker is directed during use; and wherein each directing device is of generally cross-like configuration and is rotatably mounted in the second game region, and the method comprises the step of selectively individually controlling the direction and speed of rotation of the directing devices.

29. A method as claimed in claim 28, comprising disposing wherein three directing devices adjacent each game portion.

30. A method as claimed in claim 28, comprising selecting a game portion, and subsequently directing a marker to the selected game portion by controlling the directing devices.

31. A method as claimed in claim 30, comprising randomly selecting a game portion.

32. A method as claimed in claim 28, comprising directing a marker into a game portion by randomly controlling the directing devices.

33. A method as claimed in claim 28, comprising providing each game portion with an associated identifier usable to identify game portions for bet placement purposes.

34. A method as claimed in claim 33, wherein at least one identifier comprises a symbol, number, icon or picture, or is in the form of a particular colour.

35. A method as claimed in claim 28, comprising providing each game portion with an associated identifier in the form of a multiplier usable to provide an indication to a player as to a prize awardable if the marker is directed into the game portion.

36. A method as claimed in claim 28, comprising emphasizing a game portion which receives a marker relative to game portions which do not receive a marker.

37. A method as claimed in claim 36, comprising illuminating the game portion which receives a marker.

38. A method as claimed in claim 37, comprising illuminating the game portion which receives a marker with an intensity greater than game portions which do not receive a marker.

39. A method as claimed in claim 37, comprising illuminating the game portion which receives a marker with a different colour than game portions which do not receive a marker.

40. A method as claimed in claim 37, comprising causing the game portion which receives a marker to flash.

41. A method as claimed in claim 28, wherein the first game region is of generally circular configuration, the game portions are segments of the circle, and the second game region is of generally annular configuration surrounding the first game portion.

42. A method as claimed in claim 28, wherein the marker is a ball.

* * * * *